US011045387B2

(12) United States Patent
Krumme

(10) Patent No.: US 11,045,387 B2
(45) Date of Patent: Jun. 29, 2021

(54) TIGHTLY SEALING SINGLE DOSE PACKAGING

(71) Applicant: Markus Krumme, Neuwied (DE)

(72) Inventor: Markus Krumme, Neuwied (DE)

(73) Assignee: LTS LOHMANN THERAPIE-SYSTEME AG, Andernach (DE)

( * ) Notice: Subject to any disclaimer, the term of this patent is extended or adjusted under 35 U.S.C. 154(b) by 500 days.

(21) Appl. No.: 13/922,316

(22) Filed: Jun. 20, 2013

(65) Prior Publication Data

US 2013/0341237 A1 Dec. 26, 2013

Related U.S. Application Data

(63) Continuation-in-part of application No. PCT/EP2011/006459, filed on Dec. 21, 2011.

(60) Provisional application No. 61/460,022, filed on Dec. 23, 2010.

(51) Int. Cl.

| | |
|---|---|
| ***B65D 75/62*** | (2006.01) |
| ***A61J 1/03*** | (2006.01) |
| ***B65D 75/58*** | (2006.01) |

(52) U.S. Cl.

CPC ..... *A61J 1/035* (2013.01); *B65D 75/5805* (2013.01); *B65D 75/5855* (2013.01)

(58) Field of Classification Search

CPC ..... B65D 75/30; B65D 75/527; B65D 75/42; B65D 75/44; B65D 75/46; B65D 75/58; B65D 75/5827; B65D 75/28; B65D 75/26; B65D 2571/00623; B65D 2571/00617; B65D 2571/00586; B65D 2571/0058; B65D 75/5805; B65D 2215/04

USPC ..... 206/532, 484, 530, 807; 383/201

See application file for complete search history.

(56) References Cited

U.S. PATENT DOCUMENTS

| | | | | |
|---|---|---|---|---|
| 2,325,921 | A * | 8/1943 | Salflsberg | B65D 75/38 221/282 |
| 4,567,986 | A * | 2/1986 | Eastwood | A61J 1/03 206/484 |
| 5,511,665 | A * | 4/1996 | Dressel et al. | 206/532 |
| 2004/0252920 | A1* | 12/2004 | Moteki et al. | 383/200 |
| 2006/0023976 | A1* | 2/2006 | Alvater et al. | 383/210 |
| 2009/0241483 | A1* | 10/2009 | Detwiler et al. | 53/492 |
| 2010/0326877 | A1 | 12/2010 | Hemmerlin | |
| 2011/0139784 | A1 | 6/2011 | Hemmerlin | |

(Continued)

*Primary Examiner* — Allan D Stevens

(74) *Attorney, Agent, or Firm* — Ronald S. Lombard

(57) ABSTRACT

A single-dose package for transdermal therapeutic systems or film-shaped administration forms, in the form of a tear-open sealed-edge pouch with a completely surrounding and continuous non-peelable sealing surface. The single-dose packages are provided with two packaging material elements, which are arranged one lying on top of the other and form the upper side and underside of a pouch that contains the product. At least one packaging material element is a tear-resistant film laminate with an at least three-layer structure, wherein at least one layer of the packaging material elements is a metal layer. The single-dose package also has a linear weakening, which lies in the sealing area, does not touch the edge of the package and extends in the direction of the weaker tear resistance of the upper side and underside and the linear form of the anisotropically tear-resistant plastic.

18 Claims, 2 Drawing Sheets

(56) References Cited

U.S. PATENT DOCUMENTS

| | | | | |
|---|---|---|---|---|
| 2011/0192754 | A1* | 8/2011 | Slominski et al. | 206/484 |
| 2012/0006707 | A1 | 1/2012 | Krumme | |

* cited by examiner

TIGHTLY SEALING SINGLE DOSE PACKAGING

CROSS-REFERENCE TO RELATED APPLICATION

This is a continuation-in-part application of pending international application PCT/EP2011/006459 filed Dec. 21, 2011 and claiming the priority benefit of U.S. Provisional Application No. 61/460,022 filed Dec. 23, 2010.

BACKGROUND OF THE INVENTION

The present invention relates to highly impermeable single-dose packages for film-shaped administration forms and transdermal therapeutic systems (TTS), which single-dose packages are substantially inert with respect to the active substances in the enclosed administration form but can still be opened easily without implements and are nevertheless childproof.

The present invention also concerns a method for producing the single-dose packages according to the invention, which method is distinguished by a sparing use of material, and also the use of said single-dose packages.

Packages for medicines have to perform a number of tasks. On the one hand, as a single dose, a package is intended to ensure, for example, that only a specific dose is ever taken at one time and that taking more than one dose is avoided. On the other hand, the packages are intended to ensure that the medicines are not accessible to children to take unintentionally or to administer to themselves.

A particular problem in the design of secure packages of this kind for medicines is, on the one hand, that the package is intended to provide maximum safety against unintentional self-medication, in particular by children who, driven by curiosity, open the package and confuse the medicaments, which are often coloured and aromatized to mask the bad taste and/or smell of the active substances, for sweets or other confectionery and take them, or who apply the contained transdermal therapeutic systems in the course of play.

On the other hand, however, opening the package is intended to be easy enough to ensure that adults, particularly the elderly and persons with motor difficulties, can open these packages without any problem, and to ensure good compliance in the taking of the medicines.

As is to be expected from the nature of the problem described above, a solution for achieving these objectives appears elusive, since children often approach the task of opening the package with great perseverance, ingenuity and intuition, while adult users often neglect to study the instructions or explanatory pictograms and unnecessarily take a knife or scissors to open the package, or, in the worst case, fail to take the medication because of the difficulties in opening the package if these utensils are not to hand, with the result that patient compliance falls.

A further problem with single-dose packages for film-shaped administration forms and transdermal therapeutic systems is that the surface area of the single dose is quite large in relation to the active substance content in comparison with other administration forms such as tablets or suppositories and cannot be reduced by bending and folding.

The size of the film therefore determines the size of the package. Moreover, because of the already discussed sensitivity of the films, the use of expensive high-barrier films, which can be subjected to mechanical loads and at most allow slight permeation of gases and moisture, is called for in order to ensure the necessary protection of the administration form.

This has the disadvantage that both the upper side and the underside of the large-surface administration form have to be covered with a film, which entails a high outlay in terms of material and, as a result of the expensive films, leads to high packaging costs, which can significantly increase the costs of the single dose and bring about an extremely unfavourable ratio of packaging costs to product costs. It should be noted here that childproof packages in particular often require additional outlay in terms of material in order to make them childproof.

In addition, a particular problem lies in the fact that single-dose packages are not simply intended to protect medicines from environmental influences such as light and moisture, which often lead to the active substance breaking down and, consequently, to the medicine becoming unusable. Instead, single-dose packages also have to ensure that the administration forms packaged within them do not interact with the inner coating and reduce the active substance content and therefore the efficacy of the medication as a result of diffusion and migration of active substances into this layer. In the specific case of film-shaped preparations, the aspect of the inertness of the inner contact layer of the single-dose package deserves particular attention on account of the large contact surface of coating and administration form.

A further aspect arising from the choice of films is also that, because of the large contact surface, components of the inner coating can diffuse into the administration form and, for example in the case of oral administration forms, influence the taste or even pose a risk to health. In transdermal administration forms, there is the possibility of plasticizers getting into the administration form and, because of their varied mode of action, also changing for example the rate of permeation of the active substance through the skin.

The following proposals for easy-to-open but childproof packages are known from the prior art.

The laid-open patent application DE 10 2004 047 445 A1 discloses a non-reclosable package for products harmful to health, which package has two superposed packaging material elements, a first surface portion, at the edge or edges of which the two packaging material elements are releasably connected to each other, with at least one cavity that is enclosed on all sides for receiving the packaged product being formed between the two packaging material elements, and a second surface portion, which lies outside the first surface portion or adjacent thereto and at the edge or edges of which the two packaging material elements are releasably connected to each other. At least one of the two packaging material elements is provided with at least one structure that runs within the second surface portion and that allows the packaging material element(s) to be torn into.

The laid-open patent application US 2006/0023976 A1 describes peelable pouches for one or more doses of a medicine, in which two webs of packaging material are sealed onto each other at the edge and are provided, in the area of the sealed edge, with a surface structure that allows the pouch to be torn into and is crossed by a folding line. The edge of the pouch has to be bent along the folding line in order that it can be torn into at the surface structure and opened.

The laid-open patent application DE 10 2006 041 921 A1 describes a childproof package for films containing active substance, which package comprises a carrier layer and a top layer releasably connected to the latter and, in a paired arrangement, two opposite surface areas which are separated from each other by a bridge piece and within which the top layer is not connected to the carrier layer, as a result of which two spaces that are separate from each other and enclosed on all sides are formed for receiving said films in pairs. Within said bridge piece there is another surface area in which the carrier layer is not connected to the top layer, as a result of which a cavity that is enclosed on all sides is formed. Within the bridge piece there is at least one perforation line.

The disadvantage of this approach is that a childproof package is obtained only by packaging paired films (film-shaped administration forms). Although opening the childproof safety feature in order to expose one administration form leaves the other administration form still packed in a chemically sealed manner, the childproof safety feature is no longer available. To this extent, the use of a package according to DE 10 2006 041 921 A1 is appropriate only if the interval between taking the first single dose and taking the second single dose is not too great.

The solutions mentioned above all have in common the problem that the two layers, i.e. the upper side and the underside of the package, have to be easily detachable (peelable) from each other in order to expose the administration form.

To achieve this peelability of the layers, use is generally made of sealing layers based on polyolefin, e.g. polyethylene, which have a good peeling behaviour with peeling forces of between 3 and 20 N (newtons). However, the disadvantage of this choice of material is that the sealing seams, which in contrast to the outer surfaces cannot be additionally provided with a further layer, e.g. a metal layer, in order to increase the sealing effect, do not have a high degree of impermeability to water vapour.

The minimum water vapour permeability of the single-dose package is therefore limited by the choice of the seal material.

Moreover, it is also these very sealing surfaces that form the inner layer of the single-dose package and touch the product, and therefore the material of the sealing surfaces should be compatible with the packaged product and is ideally inert with respect to the product.

Polyolefin films specifically have the disadvantage, however, that they are often not inert with respect to migration of active substance, with the result that, over the course of the storage period, the active substances migrate into the package and are thus extracted from the medicine.

In terms of use, the sealing seam strength is usually also weakened by the fact that the sealed polymers are weakened by incorporation of other auxiliaries that are not weldable. As a side effect, these auxiliaries also cause reduced sealing-seam impermeabilities for gases such as water vapour and oxygen, which impairs the storage stability of the package and can lead to problems due to water absorption of hygroscopic products, as well as to increased degradation of oxygen-sensitive products.

To solve the problem of the sealing-seam impermeability and of the migration of active substances, various solutions are proposed in the prior art, for example the use of inert layers/contact layers touching the product. Since these packages are no longer peelable, they have a nicked outer periphery that allows a tear to be started at the nick.

However, these packages are not childproof, and there is the danger, specifically in the packaging of film-shaped administration forms, that the packaged product is damaged by an uncontrolled tear profile, and the user therefore has to exercise extreme care when opening the package.

A further problem is that the material consumption for producing childproof packages is often further increased by the fact that opening the package requires the presence of unsealed portions, which serve as a gripping aid for "peeling", the minimum size of the gripping aids being limited by anatomical conditions.

Therefore, the childproof packaging of film-shaped medicines/administration forms presents a particular challenge, since films react sensitively to physical-chemical (e.g. light, moisture, oxygen) and mechanical loads. Even if the packaging of individual film-shaped administration forms meets the requirements for the protection of the individually packaged product, it has the disadvantage that it is very expensive in practical implementation, since it requires using considerable amounts of material, and the corresponding packages can only be produced relatively slowly.

The object of the present invention is therefore to make available a highly-impermeable individual package which is easy to open but nevertheless childproof, and which minimizes the consumption of packaging material per single dose and is inert with respect to migration of active substance from the administration form into the contact layer or, conversely, with respect to migration of constituents of the contact layers into the administration form.

It is in particular the object of the invention to make available a childproof single-dose package for film-shaped administration forms and also for transdermal therapeutic systems (TTS).

It is also the object of the present invention to make available a method for producing single-dose packages according to the present invention.

SUMMARY OF THE INVENTION

The object is achieved by a single-dose package according to Claim 1 of the present invention and by a corresponding method, according to Claim 11, for producing the sealed single doses.

The single-dose package of the present invention is a tear-open sealed-edge pouch with a completely surrounding and continuous, uninterrupted, non-peelable sealing surface, wherein the upper side and underside of the sealed-edge pouch are formed by two packaging material elements which are arranged one lying on top of the other and form a seat for receiving the packaged product, and wherein at least one layer of the packaging material elements that determines the tear resistance has an anisotropic tear resistance and is preferably oriented monoaxially.

Since the present invention no longer requires the sealing seams to be peelable, highly inert sealing materials can be used, which in turn has a favourable effect on the shelf life of the packaged product.

The sealing surface preferably forms the outer limits of the package, such that there is no gripping means at all for possible opening of the pouch by "peeling", i.e. opening the pouch by releasing the sealing seams from one another or from the adjacent laminate layers. In this way, opening the pouch by way of a weakened sealing seam that is not actually peelable is also prevented.

Because of the demands on the package, the packaging material elements for producing single-dose packages according to the present invention preferably have a multilayer structure. It is particularly preferable that at least one layer of the packaging material elements is a metal layer, in order to ensure the high degree of impermeability required of the single-dose package.

Furthermore, at least one packaging material element is a film laminate having an at least three-layer structure, of which the outermost layer, i.e. the layer facing away from the product, has a minimum tear resistance of 50 N, such that it is not possible for the package to be opened simply by tearing into it without any aid.

On account of the high degree of tear resistance of this first packaging material layer with at least three plies, a more affordable film laminate with a lower tear resistance can optionally be used as the second packaging material element, in order to save costs. It is preferable, however, to use identical packaging material elements for the upper side and underside of the package or as first and second packaging material layers.

In the case of a more than three-layer structure, further layers can be arranged/laminated over the layer determining the tear resistance.

In order to ensure controlled opening of the package without additional aids, which package cannot be opened manually on account of the tear-resistant layer of the laminate and the non-peelable sealing seams, the layer determining the tear resistance is composed of an anisotropically tear-resistant polymer, for example a monoaxially oriented polypropylene (PP) or polyethylene terephthalate (PET), in which the anisotropic tear resistance is achieved by a suitable composition, such that tear propagation in one direction is preferred.

The package additionally has, in the sealing area, a linear weakening (line of weakness), which does not touch the edge of the package. This line of weakness can be an incision, a perforation or another suitable kind of weakening of the tear-resistant layer that is known to a person skilled in the art and that permits further tearing of the packaging elements.

The line of weakness is preferably produced by the outer anisotropically tear-resistant polymer layer of the film laminate, directed away from the packaged product, being removed or significantly reduced in thickness, such that the tear resistance is reduced, this reduction or removal of the outermost, tear-resistant layer of the film laminates being done by laser ablation or laser scoring.

However, other methods are also conceivable, such as specific mechanical removal or chemical etching or dissolving of the outer layer in order to present the line of weakness.

When using identical, tear-resistant packaging material elements, lines of weakness lying directly on top of one another are provided on both sides of the single-dose package. The advantage of forming the line of weakness only in the outermost layer of the laminate is that the highly gas-impermeable metal layer is not damaged, and maximum protection of the packaged product from moisture and oxygen is thus permitted.

By starting a tear in the package at the line of weakness, further tearing of the anisotropically tear-resistant layer is possible. The package can thus be opened without additional aids. The line of weakness is arranged in such a way that the line of weakness extends along the direction of the lower tear resistance of the anisotropically tear-resistant polymer, in which direction further tearing is possible. The defined orientation of the layer that determines the tear resistance not only permits the further tearing, it also determines the tear profile, such that damage to the product in the product-receiving area is avoided. The orientation of the stretched polymer layer controls the tear profile, and the maximum lateral deviation of the tear profile relative to the orientation of the initial line of weakness measures ±2 mm, preferably ±1 mm. The tear extends from the sealed area of the line of weakness into the adjoining, unsealed product-receiving area, and the distance of the tear in parallel profile from the sealing surface is less than 5 mm, preferably less than 3 mm, particularly preferably less than 2 mm, and most preferably less than 1 mm.

Because of this small deviation, the safety zone of the package, where no product should be present in order to ensure that it is not damaged during opening, can be correspondingly limited, and the amount of material needed for the package can be minimized.

Since, in the embodiment according to the invention, the start of the line of weakness does not touch the periphery of the package, the package must first be bent in order to expose the start of the line of weakness along which the package can be torn open and which predetermines the tear profile. This requires only a slightly enlarged sealing area in which the line of weakness can be arranged and which, in order to expose the line of weakness, can be bent orthogonally thereto.

While this two-stage working step can be easily accomplished by an adult, it is not obvious to children.

In a particularly preferred embodiment, therefore, only the outermost, tear-resistant layer is removed level with the identified bending region running orthogonally with respect to the line of weakness, such that moreover, in the individual package, no obvious incision can be seen that could arouse the interest of children and tempt them to open the package.

In one embodiment for producing a pouch in which only a corner of the package has to be removed in order to permit removal of the product, e.g. a powder, the anisotropically tear-resistant polymer is laminated at an angle to the stretch direction, preferably 45°, in relation to the support web, such that the tear direction is not parallel to the edge of the package and a corner is exposed. In this embodiment, the line of weakness is shaped in the form of an arrow head, such that, after being bent over, the two branches of the head come to lie over one another and allow the pouch to be torn into.

In order to avoid the packaged product shifting into the tear region, another embodiment of the single-dose package has position restrictors for the product in the product-receiving area, these position restrictors preferably being produced by heat sealing. The position restrictors can be designed as narrow connecting bridges between the upper and lower film layers, or alternatively also as planar structures, e.g. triangles arranged in the edges.

As regards the arrangement of the position restrictors, it should be noted that they must not obstruct the removal of the product after the package has been opened.

In order to identify the line of weakness and make it easier to open the package, the line of weakness and/or the bending line can be identified for example by a colour marking or by other customary identifying means.

The sealed-edge pouch of the present invention is composed of two packaging material elements arranged one lying on top of the other, namely a first packaging material element and a second packaging material element, wherein at least one of the packaging material elements comprises a tear-resistant layer made of an anisotropically tear-resistant polymer, in particular a monoaxially oriented polymer.

The packaging material for producing the sealed-edge pouches is preferably a packaging material that has low permeation rates for gases and moisture.

For assuming the various functions that the packaging material has to perform, packaging materials having an at least three-layer structure are particularly well suited, in which case the individual plies or layers of the packaging material are bonded together to form a composite, preferably in the form of a laminate. The individual layers of the packaging material assume one or more functions that are essential for achieving the object of the present invention.

According to the present invention, at least one layer, preferably the outermost layer, of the packaging material element is distinguished by a high anisotropic tear resistance. This layer cannot be destroyed manually without additional implements. However, an existing tear, which has been produced at a predetermined weakened point, can be extended, and a tear propagation achieved in the direction of the weaker tear resistance, i.e. in the direction of orientation of the polymer, such that further tearing manually and without aids is possible.

A PP layer or PET layer of suitable composition with monoaxial orientation is preferred. Such a layer is particularly preferably a monoaxially oriented polyethylene terephthalate layer or polypropylene layer with a layer thickness of 10-100 μm, preferably 20-50 μm, and particularly preferably 12-25 μm. However, other materials familiar to a person skilled in the art and with anisotropic tear resistance can also be used in suitable layer thicknesses. These materials have preferably been produced by monoaxial stretching.

The outer layer can also preferably be printed on, such that, for example, product identifications and tearing-open suggestions can be provided.

A second layer, or in the case of a three-layer structure the middle layer, is composed of a metal film, preferably aluminium, with a thickness of 9-25 μm. This metal layer provides the impermeability of the package with respect to moisture and air.

The inner layer is a sealable plastic layer, and it is not possible for the sealing seam produced by this layer to be opened again.

The connecting of the laminates is preferably done by heat sealing, but it can also be done by any other suitable sealing method, such as cold sealing, ultrasonic sealing, laser sealing, or comparable film welding methods known to a person skilled in the art, as long as a non-releasable sealing seam is obtained.

The sealing seams or sealing surfaces preferably have a width of 0.1 mm to 10 cm, particularly preferably a width of 1 mm to 2 cm, and very particularly preferably a width of 2 mm to 8 mm, and they preferably extend over the entire length and width of the packaging material elements. At particularly exposed points, the sealing seam width can also be larger, for example in order to permit bending to expose the line of weakness. On the other hand, at least one of the sealing seams can be made stronger and wider than the other sealing seams, in order to make opening the package additionally more difficult at this location.

As plastics for the sealing surfaces, materials known to a person skilled in the art can be used, such as polyvinyl chloride (PVC), polyvinylidene chloride (PVDC), Barex® (BP Chemicals; copolymer of acrylonitrile and butadiene), Surlyn®, Aclar™ (Honeywell; high-barrier films of polychlorofluoroethylene [PCTFE]) and Topas®-COC (Ticona; cyclo-olefin copolymer films), the layer thickness typically being 10-100 μm, preferably 10-50 μm, and particularly suitable plastics are those that are highly impermeable, behave inertly with respect to the active substance of the packaged administration form and/or adsorb the active substance only slightly.

A particularly preferred high-barrier film laminate for use as a packaging material element is composed of a Barex® layer (20-40 μm), an aluminium film (9-25 μm) and a PET layer (10-30 μm).

The thickness of the multi-ply film laminate preferably lies in the range of 35 to 300 μm, particularly preferably 50 to 200 μm.

The tear resistance and tear propagation resistance of the packaging material can be determined by means of known tensile testing machines using a sample holder for tear tests (type no. 00740) (e.g. obtainable from FRANK Prüfgeräte GmbH, 69488 Birkenau, Germany).

The weaker, anisotropic tear resistance of the packaging material is at least 50 N, preferably at least 60 N, and particularly preferably at least 70 N, measured on the two interconnected packaging material elements that form the package.

If different film laminates are used as the first and the second packaging material element, the minimum tearability of the second film laminate lies below that of the first film laminate, preferably in the range of 10 N to 50 N, particularly preferably in the range of 20 N to 40 N.

The weaker tear propagation resistance of the anisotropic packaging material must not be too low, because adequate protection of the packaged product can then no longer be ensured and there is the risk of the package being unintentionally opened and/or the packaged product being damaged. This can be determined by simple tests. The weaker tear propagation resistance of the packaging material is preferably less than 10 N, measured on the two interconnected packaging material elements that form the package.

To make further tearing of the packaging material possible or easier, the tear resistance is a multiple of the tear propagation resistance. The ratio of tear resistance to tear propagation resistance preferably lies in the range of 50:1 to 150:1, relative to the tear resistance and tear propagation resistance of the two interconnected packaging material elements.

BRIEF DESCRIPTION OF THE DRAWINGS

The single-dose package according to the invention is explained in more detail below with reference to the figures. The figures serve only to illustrate the invention and do not limit the invention to what is shown.

DETAILED DESCRIPTION OF THE INVENTION

Figure 1:
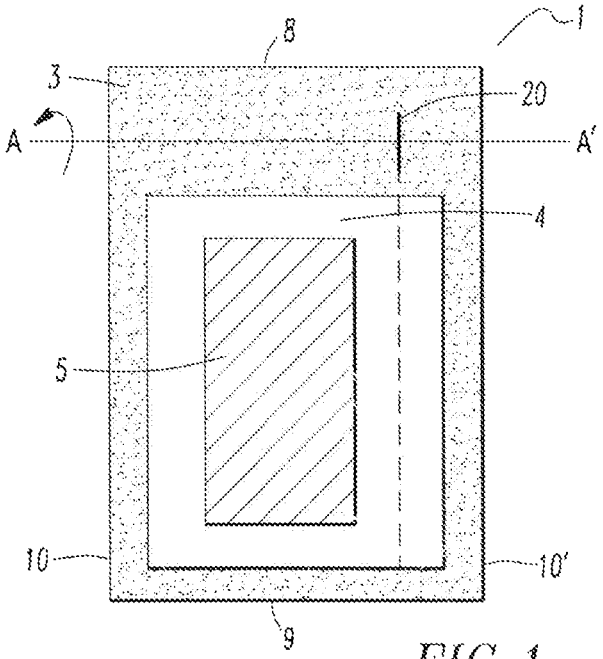
FIG. 1 shows a preferred embodiment of the single-dose package according to the invention in a plan view, with an area of weakness arranged in the upper edge.

The package according to the invention is a sealed-edge pouch comprising two superposed packaging material elements, of which one packaging material element forms the top layer and the other packaging material element forms the bottom layer, between which the product (5), preferably a transdermal therapeutic system or a film-shaped administration form, is arranged. The two packaging material elements are sealed onto each other in such way that the product (5) is enclosed by a surrounding, continuous sealing edge (3), which is not peelable. This results in a product-receiving area (4) which is closed on all sides and in which the product (5) is contained.

The sealed-edge pouch (1) has a front border (8), a rear border (9) and two preferably parallel side borders (10, 10').

Moreover, the sealed-edge pouch has a line of weakness (20), in the direction of which the packaging material elements can be torn open.

Figure 2:
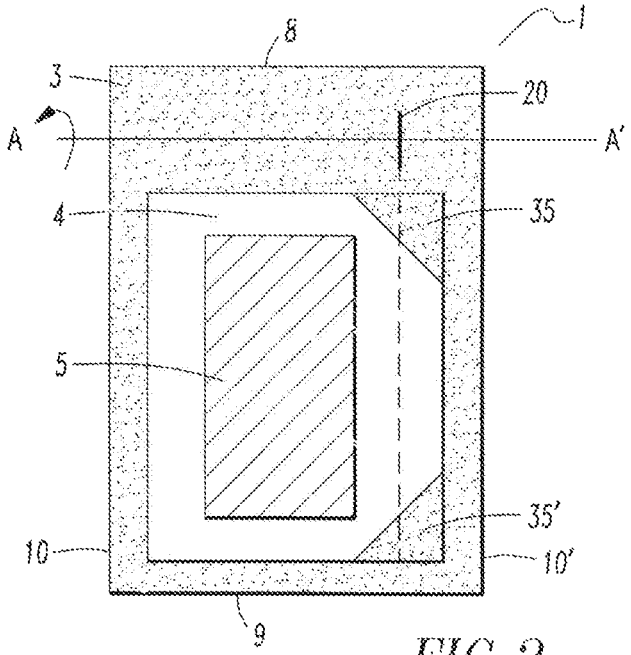
FIG. 2 shows a single-dose package with position restrictors.

In addition, the sealed-edge pouch in FIG. 2 has position restrictors (35, 35'), which prevent shifting of the product into the tear region.

The package is made childproof by virtue of the fact that the lines of weakness for tearing open the package can be exposed only by overcoming a childproof safety feature. This safety feature results from the fact that the lines of weakness do not extend as far as the edge, and the otherwise tear-resistant material of the packaging material elements can be torn open, and the product removed, only after the start of the line of weakness has been exposed by bending the package over along a bending line, which can optionally be predefined.

Because of the tear resistance of the packaging material, it is impossible for the package to be torn into manually in other areas.

According to the invention, the line of weakness for tearing into the packaging material should not touch the edge of the package, such that this structure exposes the start of the area of weakness for tearing-in only when the package is folded along a line running through this structure, for example along the line A-A' (FIG. 1).

Said line of weakness, which makes it possible for the packaging material element(s) to be torn into, can be present in one of the two packaging material elements, for example if the second packaging material element has a lower tear resistance, or in both packaging material elements, the last-mentioned embodiment being preferred. In this case, the line of weakness for tearing into the packaging material is arranged congruently in both packaging material elements. However, the line of weakness can also be a cut or a perforation.

By means of the combination, according to the invention, of a packaging material with anisotropically tear-resistant and in particular monoaxially oriented polymer film, of the line of weakness, and of the design of the childproof safety feature, it is possible to design the package in such a way that it can be opened only by an ordered sequence of at least two steps:

(i) folding or bending the package over along a line, by which means the weakening structure for tearing into the package becomes accessible;

(ii) tearing into the package at the weakening structure then located at the edge, and further tearing along the direction of this structure.

This handling involves considerable difficulties for children, particularly for infants, especially since the line of weakness is not readily discernible, and, in a preferred embodiment, there is only slight removal of material and no incision. For adults, however, it is possible without any problem and without the aid of implements. In a particularly preferred embodiment, the single-dose package is childproof in accordance with DIN EN 14375 and/or ASTM D3475-03a.

The present invention also relates to a method for producing a single-dose package for transdermal therapeutic systems or film-shaped administration forms. This method is distinguished by the fact that it is particularly material-saving compared to the known methods.

Since there are no peelable seals present and the package is torn directly along the line of weakness, no additional surfaces that expose gripping aids and the like, as are known from DE 10 2004 047 445 A1, are needed for a childproof package. The individual packages lie directly against one another, and additional material consumption, beyond the size of the packaged product, is occasioned only by the thickness of the sealing surfaces and, in certain embodiments, by the protuberances and position restrictors. There is likewise no scrap caused by a complex outer shape. The single-dose packages according to the invention can therefore be produced without loss of packaging material.

The method for producing a single-dose package according to one of the preceding claims comprises the following steps:

- providing a first packaging material web having an at least three-layer structure, wherein the packaging material web comprises a tear-resistant layer made of an anisotropically tear-resistant and preferably monoaxially oriented polymer;
- providing a second packaging material web;
- positioning the packaged product on one of the two packaging material webs;
- superposing and connecting the two packaging material webs in such a way as to form for each packaged product a compartment that is closed on all sides and receives the packaged product, at the edge or edges of which compartment the two packaging material elements are connected to each other unreleasably;
- providing at least one line of weakness by incision, perforation or removal of the uppermost, tear-resistant film layer of the multi-layer film laminate, wherein the line of weakness does not however touch the edge of the package;
- individually separating the successive package units by a cut or a perforation along a line that runs transversely with respect to the web direction of the packaging material webs in the area of the sealing surface.

The sequence of the method steps that is indicated above is not obligatory; for example, the lines of weakness for tearing into the packaging material can also be provided only in a later step.

The unreleasable connection between the packaging material elements is preferably produced by heat sealing at temperatures in the range between 50° C. and 200° C., in particular 100° C. to 200° C. However, the unreleasable connection between the two packaging material webs can also be produced by other heat sealing or cold sealing methods such as ultrasonic sealing, laser sealing or the like.

The package can, for example, be efficiently produced from strip stock by series production on rotary sealing machines.

In a preferred embodiment, the line of weakness is obtained by laser ablation or laser scoring during production, the lines of weakness being provided congruently and directly opposite one another when tear-resistant film laminates are used for the first and second packaging material elements.

In another embodiment, position restrictors are arranged in the product-receiving area, preferably by heat sealing.

Figure 3:
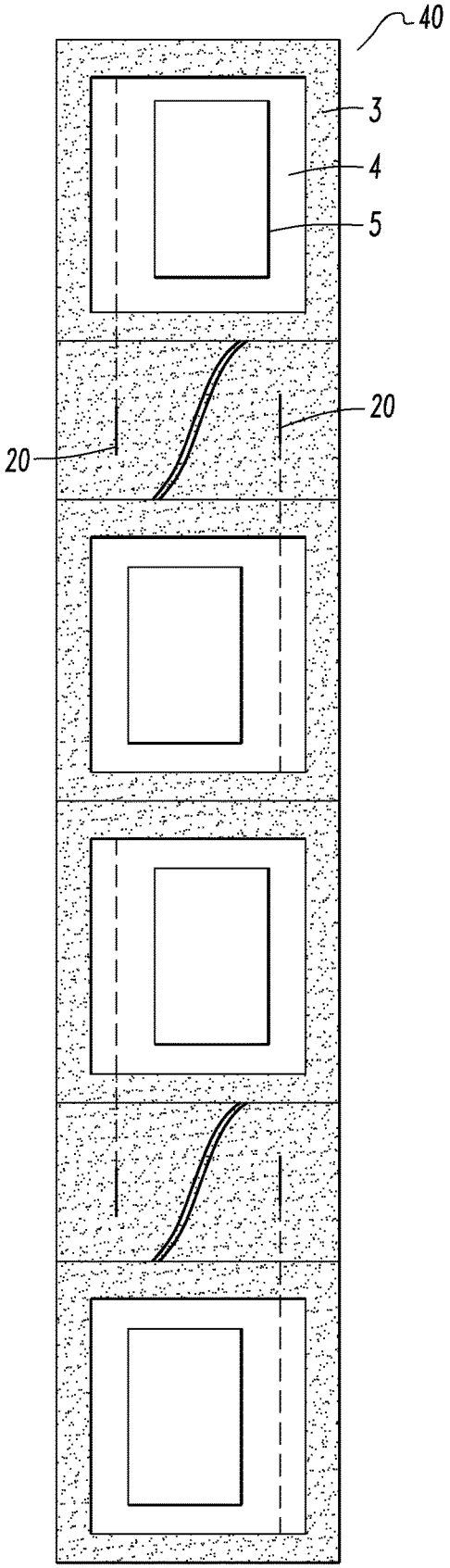
FIG. 3 shows a strip of single-dose packages connected in pairs in waste-free production.

In a particularly preferred embodiment according to FIG. 3, the individual packages are produced as a waste-free strip (40), with pairs of packages being formed.

Two single-dose packages in a pair of packages are connected with point symmetry via tabs.

The present invention further relates to the use of the single-dose packages described above for the packaging of transdermal therapeutic systems or film-shaped administration forms.

What is claimed is:

1. A childproof single-dose package configured to contain transdermal therapeutic systems or film-shaped administration forms, comprising:

a tear-open sealed-edge pouch with a completely surrounding and continuous non-peelable sealing surface forming a surrounding, continuous, non-releasable sealing edge, the tear-open sealed-edged pouch comprising two packaging material elements, which are arranged one lying on top of the other and form an upper side and an underside of the tear-open sealed-edge pouch including a product-receiving area that contains a packaged product and the surrounding, continuous, non-releasable sealing edge surrounding the product-receiving area, at least one of the packaging material elements including a tear-resistant film laminate with an at least three-layer structure, and at least one layer of the packaging material elements is a metal layer, the tear-resistant film laminate having a tear-resistant layer having a controlled tear profile, the tear-resistant layer is an outer layer with respect to the metal layer and is comprised of a plastic with anisotropic tear resistance which is oriented monoaxially, of which a minimum tear resistance in a weaker direction is at least 50 N, measured with respect to the tear-resistant layer, the single-dose package has a line of weakness comprising a perforation or reduction located only in the tear-resistant layer, the line of weakness lies in the surrounding, continuous, non-releasable sealing edge, does not touch a periphery of the package, the line of weakness is oriented such that it extends in the weaker direction of the monoaxially oriented anisotropic tear-resistant layer, the monoaxially oriented anisotropic tear-resistant layer configured to permit a tear propagation originating from the oriented line of weakness without such perforation or reduction of the line of weakness in the product receiving area, the permitted tear propagation extending in the monoaxially oriented anisotropic tear-resistant layer in the weaker direction of tear resistance of the monoaxially oriented anisotropic tear-resistant layer and the permitted tear propagation having a predetermined maximum lateral deviation of a tear profile relative to the orientation of the line of weakness and the permitted tear propagation extending from the line of weakness in the surrounding, continuous, non-releasable sealing edge in the weaker direction of the minimum tear resistance of the anisotropic tear-resistant layer into the product-receiving area and to the surrounding, continuous, non-releasable sealing edge, the permitted tear propagation within the product-receiving area extending in a predetermined maximum distance in parallel profile from the completely surrounding and continuous non-peelable sealing surface, and, position restrictors adjacent the product-receiving area and adjacent the completely surrounding and continuous non-releasable sealing edge and arranged such that the permitted tear propagation transverses each of the position restrictors and each of the position restrictors configured to prevent the product from shifting into the area of the permitted tear propagation prior to opening the package.

2. The single-dose package according to claim 1, wherein the plastic of the tear-resistant layer is chosen from the group consisting of polypropylene and polyethylene terephthalate.

3. The single-dose package according to claim 1, wherein the plastic for the completely surrounding and continuous non-peelable sealing surface of the tear-open sealed-edge pouch is chosen from the group consisting of highly gas-impermeable plastics that are inert with respect to an active substance, in particular polyvinyl chloride (PVC), polyvinylidene chloride (PVDC), copolymers of acrylonitrile and butadiene, polychloro-fluoroethylene (PCTFE) and cyclo-olefin copolymer films, wherein a layer thickness of the completely surrounding and continuous non-peelable sealing surface is 10-100 μm.

4. The single-dose package of claim 3, wherein a layer of the sealing surface is 10-50 μm.

5. The single-dose package according to claim 1, wherein the line of weakness is formed by laser ablation of the tear-resistant layer of the at least three-layer film laminate of the packaging material elements, or is a cut or a perforation.

6. The single-dose package according to claim 1, wherein the line of weakness has a length of 2-10 mm.

7. The single-dose package according to claim 1, wherein the tear propagation extends in parallel profile at the maximum predetermined distance of less than 1 mm from the completely surrounding and continuous non-peelable sealing surface.

8. The single-dose package according to claim 1, wherein the two packaging material elements have the same structure having lines of weakness lying on top of one another.

9. The single-dose package according to claim 1, wherein a tear propagation resistance of the packaging material elements is less than 10 N, and a ratio of tear resistance to tear propagation resistance lies in the range of 20:1 to 200:1 of the two interconnected packaging material elements.

10. The single-dose package of claim 9, wherein the ratio of tear resistance to tear propagation lies in the range of 50:1 to 150:1.

11. The single-dose package of claim 1, wherein one of the two packaging material elements includes a film laminate with a lower tear resistance than a second of the packaging material elements.

12. The single-dose package of claim 1, wherein the package further includes a bending line for permitting access to the line of weakness.

13. The single-dose package of claim 12, wherein the bending line is positioned transverse to the line of weakness.

14. The single-dose package of claim 1, wherein the predetermined maximum lateral deviation of the tear profile relative to the orientation of the line of weakness is from plus 2 millimeters to minus 2 millimeters.

15. The single-dose package of claim 1, where the predetermined maximum lateral deviation of the tear profile relative to the orientation of the line of weakness is between plus or minus 2 millimeters.

16. A method for producing a single-dose package including a packaged product, said single-dose package for transdermal therapeutic systems or film-shaped administration forms, comprising:

a tear-open sealed-edge pouch with a completely surrounding and continuous non-peelable sealing surface forming a surrounding, continuous, non-releasable sealing edge, the tear-open sealed-edged pouch comprising two packaging material elements, which are arranged one lying on top of the other and form an upper side and an underside of the tear-open sealed-edge pouch including a product-receiving area that contains the packaged product and the sealing edge surrounding the product-receiving area, at least one of the packaging material elements including a tear-resistant film laminate with an at least three-layer structure, and at least one layer of the packaging material elements is a metal layer, the tear-resistant film laminate having a tear-resistant layer having a controlled tear profile, the tear-resistant layer with respect to the metal layer and is comprised of a plastic with anisotropic tear resistance which is oriented monoaxially, of which a minimum tear resistance in a weaker direction is at least 50 N, measured with respect to the tear-resistant layer, the single-dose package has a line of weakness comprising a perforation or reduction located only in the monoaxially oriented tear-resistant layer, which lies in the surrounding, continuous, non-releasable sealing edge, does not touch a periphery of the package, the line of weakness is oriented such that it extends in the weaker direction of the monoaxially oriented anisotropic tear-resistant layer, the monoaxially oriented tear-resistant layer configured to permit a tear propagation originating from the oriented line of weakness without such perforation or reduction of the line of weakness extending in the product receiving area, the permitted tear propagation extending in the weaker direction of tear resistance of the monoaxially oriented tear-resistant layer and the permitted tear propagation having a predetermined maximum lateral deviation of a tear profile relative to the orientation of the line of weakness and the permitted tear propagation extending from the line of weakness in the surrounding, continuous, non-releasable sealing edge in the weaker direction of the minimum tear resistance of the tear-resistant layer into the product-receiving area and to the surrounding, continuous, non-releasable sealing edge, the permitted tear propagation extending in the product-receiving area a predetermined maximum distance in parallel profile from the completely surrounding and continuous non-peelable sealing surface, position restrictors adjacent the product-receiving area and adjacent the completely surrounding, continuous, non-releasable sealing edge and the position restrictors arranged such that the permitted tear propagation transverses each of the position restrictors and the position restrictors proximate the permitted tear propagation configured to prevent the product from shifting into the area of the permitted tear propagation prior to opening the package, said method comprising the following steps:

providing the two packaging material elements including a first packaging material element having the at least three-layer film laminate with at least one layer of the packaging material elements is a metal layer, providing the tear-resistant layer having a controlled tear profile made of the plastic with the anisotropic tear resistance and is monoaxially oriented, positioning the tear-resistant layer as an outer layer with respect to the metal layer;

positioning the packaged product on one of the two packaging material elements;

superposing and connecting the two packaging material elements to form the product-receiving area for the packaged product, the product-receiving area is closed on all sides and receives the packaged product, the two packaging material elements are connected to each other unreleasably to form a non-peelable sealing surface forming the surrounding, continuous, non-releasable sealing edge surrounding the product-receiving area;

providing the line of weakness in the surrounding, continuous, non-releasable sealing edge in the weaker direction of the predetermined minimum tear resistance of the monoaxially oriented anisotropically tear-resistant layer, permitting the tear propagation in the monoaxially oriented anisotropically tear-resistant layer having the predetermined maximum lateral deviation of the tear profile relative to the orientation of the line of weakness and the permitted tear propagation extending in the weaker direction of the predetermined minimum tear resistance from the surrounding, continuous, non-releasable sealing edge into the product-receiving area and extending in the product-receiving area the predetermined maximum distance in parallel profile from the completely surrounding and continuous non-peelable sealing surface, and, providing the position restrictors adjacent the product-receiving area and adjacent the surrounding, continuous, non-releasable sealing edge and arranged such that the permitted tear propagation transverses each of the position restrictors and each of the position restrictors configured to prevent the product from shifting into the area of the permitted tear propagation prior to opening of the package.

17. The method according to claim 16, further comprising producing the at least one line of weakness by laser ablation or laser scoring.

18. The method according to claim 16, further comprising forming in a first laminate in at least three layers having a first line of weakness in the monoaxially oriented tear-resistant layer in the first packaging material element and a second film laminate in at least three layers having a second line of weakness in the monoaxially oriented tear-resistant layer in the second of the two packaging material elements, and arranging the first and second lines of weakness directly opposite one another.

* * * * *